United States Patent [19]

Fitzpatrick et al.

[11] 4,008,884

[45] Feb. 22, 1977

[54] STIRRING MOLTEN METAL

[75] Inventors: Nigel Patrick Fitzpatrick, Kingston, Canada; James Neville Byrne, Banbury, England; Angus James MacDonald, Kingston, Canada

[73] Assignee: Alcan Research and Development Limited, Montreal, Canada

[22] Filed: June 17, 1976

[21] Appl. No.: 697,113

[52] U.S. Cl. ..... 266/233; 75/93 R

[51] Int. Cl.[2] ..... C22B 9/02

[58] Field of Search ..... 75/50, 61, 65 R, 68 R, 75/93 R; 266/233, 239, 44

[56] References Cited

UNITED STATES PATENTS 3,490,896 1/1970 Steinke ..... 75/61

*Primary Examiner*—Gerald A. Dost

*Attorney, Agent, or Firm*—Cooper, Dunham, Clark, Griffin & Moran

[57] ABSTRACT

For stirring molten metal such as aluminum in a furnace, metal is alternately withdrawn from and discharged as a jet into the body of molten metal, such being effected by successive application of suction and gaseous pressure to a tubular vessel which projects beneath the surface of the molten metal for advantageously delivering the successive quantities in a horizontal direction over a preferably long path. Effective, reliable stirring of the entire body of metal is achieved with one or more such means, the extent of stirring being controllable; the results include saving of energy and of time for furnace operation, and reduction of melt loss.

34 Claims, 13 Drawing Figures

STIRRING MOLTEN METAL

BACKGROUND OF THE INVENTION

This invention relates to stirring molten metal and in a particular sense to procedure and apparatus for stirring metal such as aluminum in a furnace where the metal is melted, such stirring being effected for any of a variety of purposes, for example as to facilitate the melting of further portions of solid metal in an initial quantity of molten metal, or the mixing of added molten metal, or to effect incorporation of additions, e.g. other metals or the like for alloying, grain refining or similar functions, in an existing melt, or to maintain uniformity of composition or temperature in a standing body of molten metal.

One general type of furnace used for such melting operations with aluminum (herein understood to include aluminum alloys) embraces a horizontal vessel preferably of rectangular plan and commonly covered to provide a space wherein heat can be supplied by direct firing, i.e., with one or more fuel-burning nozzles directing flame across and downwardly toward the surface of the metal. Means are provided, as with doors in an upper part of a wall of the furnace, or a side well partitioned from the main chamber, for charging the furnace, and likewise means for tapping the melt, as by opening a conventional tap hole. In some cases, the furnace is arranged to be tilted, e.g. so that the metal can then run out through a spout, to be taken directly or indirectly to casting apparatus.

In these reverberatory and other types of melting furnace, it is desirable to stir the molten bath, e.g. to assist the melting operation, to reduce clustering of sludge on the furnace floor, to avoid inefficiency by losing heat from the surface without carrying it to lower levels of the melt, and especially to expedite dissolution of alloying additions, grain refiners and the like. A variety of methods have been used, including manual stirring by moving blades or like implements through the metal (causing turbulence, but little bulk flow), and different electromagnetic or analogous techniques. Among the latter are: induction stirring caused by external current paths, i.e., beneath the floor, stirring by magnetic means under the floor coacting with current, e.g. D.C., in the bath, and use of so-called jumping ring pumps placed in side wells to cause flow between the well and main chamber. Rotating mechanical paddles are also employed, for instance operated by an air motor; while this technique can induce major bulk flow by causing heavy local turbulence, it is not consistent with continuous use during firing.

The various electromagnetic methods can be designed to cause bulk flow and some local turbulence, but are apt to be expensive and difficult to embody with a furnace, or only partially effective.

There have been a number of other proposals, as for pumping molten metal between a melting chamber and a separate heating chamber, or in the case of some deep types of furnace or holding vessel, as for steel, by pumping the metal up to and through an upper vessel. In general, however, all of the prior methods have been less than fully satisfactory, for one or more of the reasons of cost of installation or operation, incomplete effectiveness in moving anything like all of the metal, availability only at special or limited times in the process of melting or holding the metal, and difficulty of construction in a way compatible with submergence in molten metal.

Of course, a very large variety of techniques have been employed or suggested for agitating liquids very different from molten metal, i.e., normal aqueous or other materials that are fluid at much lower temperatures, including the use of multiple stirring elements, or of vibrating means, or of means for moving liquid into and out of a large multiplicity of submerged apertures. It has not been at all feasible to use such methods for metal; indeed it has been apparent that complex structures or movable constructions cannot be achieved with heavy, brick-lined furnaces or with materials that will withstand the very high temperatures, the heavy mechanical loading, or the rapidly deteriorating effect of molten aluminum or other metal.

In consequence, there has remained a need for improvement in procedure or equipment for stirring large bodies of metal in furnaces, and at the same time there has been a lack of clear appreciation of some important advantages and economies that are attainable, as explained below, with good stirring operable throughout a large proportion of the time of using the furnace, whether for initial melting, dissolution of additions, or holding until or through successive tappings.

SUMMARY OF THE INVENTION

To effectuate the stirring of molten metal in a significantly improved manner for melting operations of the character described, the procedural aspect of the present invention embraces the steps of alternately withdrawing a relatively small amount of metal upward from beneath the surface of a melt body in a furnace and rapidly expelling such amount of metal as a relatively high velocity jet, also beneath such surface and desirably in a direction extending along a path of substantial length. Such path is preferably selected to be both parallel and close to the bottom of the melt body, while the steps of withdrawal and jet expulsion are continued in immediate, alternating succession. The operation is controllable to have the effect, if desired, of creating massive, circulatory flow through a large volume of molten metal, or a lesser degree of mixing as circumstance may require.

These actions of withdrawing and delivering metal can be effected in a tubular vessel which extends above the surface of the melt body, conveniently in a sloping manner to a locality outside the furnace wall, and with an opening at the lower end to receive the metal and project it in the desired direction. Very advantageously the alternating movements of metal are produced by maintaining gaseous fluid, e.g. air, in an upper part of the vessel, where suction and pressure are successively applied. With this pneumatic action, mechanical engagements with the molten metal are entirely avoided, and there is great simplicity of structure that is required to be in contact with the body of melt or the portions of molten metal that are moved out of and into the melt.

It is found that such operation, especially by virtue of the submerged jet discharge, creates an unusually effective flow of metal which can cause a substantial circulation around and indeed throughout a horizontally large area. For a considerable distance, the jet may inherently be accompanied by turbulence, e.g. along its conical or like path of the jet, as well as within the jet flow. The propelled volume continues flowing with approximately uniform velocity at remote regions. The method is notably suited for treatment of metal in a body that extends very predominantly in horizontal rather than vertical direction, as for example in a reverberatory furnace where the molten bath has a depth which, although several feet or more, is much less than its horizontal dimension or dimensions. A common example of such furnace may be generally rectangular in plan, with at least one of its dimensions, and usually both, much greater than the available depth of the contained melt — indeed equal to several times such depth.

In many cases, it appears that a single locality of metal withdrawal and jet expulsion is sufficient, e.g. near one wall or horizontal corner, to project the jet parallel to or toward the midpoint of a wall, being the longer wall in an oblong chamber. Alternatively, such operation can be effected at a plurality of places, for example so that there are two jets at diagonally opposite corners, directing metal in the above ways relative to parallel walls, in respectively opposite directions.

The apparatus of the invention comprises, in combination with a furnace of the nature described (which can be conveniently here called a melting furnace, whether used or specially designed for melting, holding, alloying, treating or a variety of these or other functions), the novel stirring means including a tubular conduit structure arranged to project downwardly, e.g. obliquely or vertically, into the molten metal, and cooperating means for producing the withdrawal and delivery of metal through a nozzle at the lower end of the tubular structure. Preferably the tube extends upwardly out of the furnace enclosure, i.e., through the roof or side wall. Thus a very satisfactory arrangement involves a tube, made or coated (inside and out) with material resistant to deterioration by heat and molten aluminum, and having a nozzle of reduced cross-section that has a composition very highly resistant to such deterioration. If slanted, the tube may make a convenient angle to the horizontal (e.g. in a range of about 25° to 60°) and may pass through the wall of the furnace to a locality substantially above the level to which the surface of the melt may reach. The tube can be arranged so that at the lower end its internal passage bends toward or into approximately horizontal direction, for corresponding delivery of metal through the nozzle.

Means for alternately applying suction and pressure to an upper part of the tubular vessel are appropriately connected to such part. Although a variety of different embodiments, including pumps, reservoirs, or other pneumatic devices, may be utilized for the suction and pressure means, a very effective instrumentality embraces an ejector designed for use with gaseous fluid and having, internally, the usual narrowed flow path with a gap or opening that has a lateral suction outlet through which a vacuum or suction may be built up. The apparatus exemplified by the use of the ejector may include connection between such outlet and the upper part of the stirrer nozzle tube, and a supply of fluid, e.g. air under pressure. Thus the compressed air is first supplied to the normal inlet of the ejector and exhausts through the normal ejector discharge, thereby building up vacuum in the stirrer tube and correspondingly drawing molten metal into it, to the desired amount at a desired level above the melt body surface. Then the inlet of compressed air to the ejector is closed, and the ejector discharge is connected (instead of to the atmosphere) to the compressed air supply, whereby the metal in the tubular vessel is expelled forcefully and rapidly, as the desired submerged jet. Means can be provided for continuously repeating the cycle of operation, alternating such suction and pressure, to create periodic jet discharges of metal, for the desired stirring effect.

A variety of controlling instrumentalities are conceived, including the employment of time delay relays or the like for successively actuating the suction and blow (discharge) phases of the cycles. If desired, in the implementation of these or other control instrumentalities, one or more probe elements may project into the stirrer tube, e.g. at or near its upper end. Metal may be so detected in the tube in various ways, as by an interruptible gas jet, a nuclear radiation-type level indicator, an ultrasonic probe, or a thermocouple; or measurement of the natural frequency of vibration of the tube could detect the rising metal. For example, a very effective probe may be responsive electrically to metal contact, e.g. as a warning that the tube is overfilled. Similarly responsive probes in lower localities may directly control the operation, for instance to signal the arrival of metal for interrupting suction and starting the jet discharge part of the cycle. It is of particular significance that the apparatus can be controlled in a variety of ways as to extent or degree of stirring, for instance by adjusting the energy or velocity of metal discharge in the blow parts of the cycles, and also by varying the frequency of the cycles.

Although suitable locations for the stirring tube have been indicated above, a variety of other dispositions are useful, generally at low localities of the molten bath (although in special cases, upper positions are conceivable) but mostly so as to direct a flow horizontally along a considerable, linear path. In general, the chief aims are some combination of circulation and turbulence, for optimum stirring.

In some instances, the furnace may be of a so-called side well type, as for example in having a portion partitioned from the main chamber in which heating occurs, the partitioned well being open to the atmosphere or covered by removable means. Thus such side well may extend along one side of the furnace, communicating with the main chamber through submerged passages and being useful to receive solid charge and particularly additions for alloying or other function, as exemplified by manganese and grain-refining substances.

With side well furnaces, the jet stirring tube or tubes can again be located in various places, e.g. relative to the well, the main chamber, and the communicating passages. As will be understood, such disposition can depend on whether the agitation of molten metal is to predominate in the well or to occur mostly in the main chamber or to relate chiefly to moving metal into and out of the well.

In practice of the invention, means are advantageously provided for adjusting the vacuum or suction in the stirrer tube, e.g. so that the metal is preferably pulled up to a selected maximum level but not beyond. Such selected vacuum will vary with the depth of metal in the furnace, or more particularly with the depth of the jet nozzle of the tube below a melt level, i.e., the height to which the furnace is filled above the normally fixed position of the stirrer nozzle. In general, the shorter the depth of the nozzle below the surface, the greater the vacuum may be (and ordinarily should be) for the suction stroke. For instance, in one set of operations, where the depths were 12 inches, 24 inches, and 36 inches (of the submerged nozzle), suitable selected vacuum values to elevate metal to a single preselected point in the tube were 11 inches, 9 inches, and 7 inches of mercury, meaning respectively values corresponding to such departures of a barometric mercury column below normal atmospheric pressure value. As will be understood, these values are simply indicative examples, in that the actual extent of suction may vary with the type of aluminum alloy as well as with selected temperature. For instance, at lower temperatures (closer to the melting point) the viscosity of molten aluminum increases, permitting or requiring higher levels or degrees of vacuum in the stirrer tube, especially if the duration of each suction step is time-controlled.

As indicated above, the invention has been found to yield substantial new results and superior advantages in metal-melting practice. Although it is apparent that the invention is usefully applicable to other metals, particularly other light and non-ferrous metals (and indeed without restriction to the metal type in some of its more general aspects), practical tests of the procedure and apparatus, as herein described, have been with aluminum and with various melting requirements in situations of treating and handling such metal, including its alloys.

It has been specifically found that more heat can be taken into the liquid metal e.g. from the burner or burners, in the sense that the heat transferred to the bath increases by a significant amount, for example of the order of 12%, when the effective stirring of the invention is used. This represents considerable economy and advantage, not only directly by saving of fuel but also by reason of shortening of the time required for melting or like operations.

There is a greater proportion of submerged melting with the occurrence of vigorous stirring according to the invention, from which at least one advantage is a decrease of melt loss. That is to say, there is a reduced production of oxide or other compounds such as occur where there is long exposure of the melt surface to heat and atmosphere in order to achieve the desired dissolution and melting.

As distinguished from prior stirring operations, particularly by mechanical means such as manual devices or air motor-actuated devices, the stirrer of the present invention is not only more efficient and capable of much more effective stirring action, but there is a further saving of fuel in that there is much less opening of the furnace doors heretofore required to use or control the stirring means. Moreover, there is no conflict at all with the operation of the burners.

Since the furnace can be kept in a fairly uniform molten state, with the metal at a desired temperature from bottom to surface of the furnace, operations such as for dissolving manganese are more readily effected in that there is no need to preheat any so-called heel or lower part of the furnace charge to a high temperature to obtain dissolution as occurred in past practice. At the same time, agitation of the metal with the introduced manganese is greatly facilitated because of better turbulence and the better circulation that distributes the addition throughout the entire furnace charge.

Finally, in some examples of operation, significantly reduced times have been found feasible to prepare a batch of typical charges of scrap and hot metal, with corresponding economy. Moreover, the stirrer permits maintenance of lower surface temperature in a standing melt, with correspondingly reduced effects in producing unwanted compounds, such as hard magnesium oxides when magnesium is an alloying element. As indicated, a great advantage of the stirrer is that it may be operated, if desired, at all times without regard to functioning of the burners and usually without regard to opening or closing of the furnace doors or the act of introducing additional solid or liquid charge.

DETAILED DESCRIPTION

Figure 1:
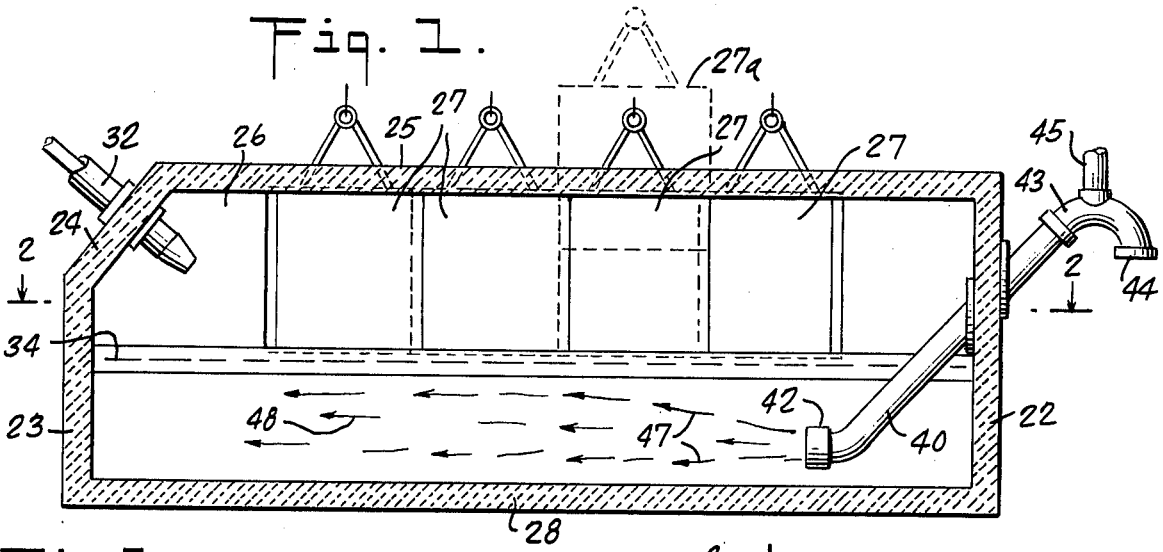
FIG. 1 is a very simplified view, in longitudinal vertical section on line 1—1 of FIG. 2, of one form of melting furnace with an example of stirrer pipe applied thereto in accordance with the invention.
Figure 2:
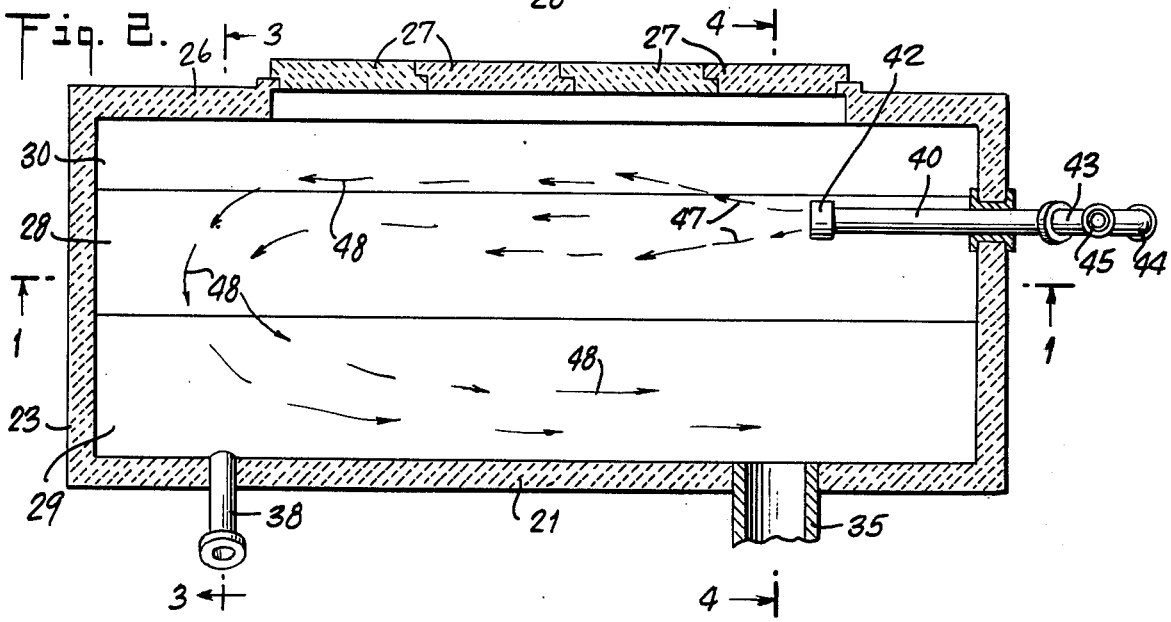
FIG. 2 is a horizontal section on line 2—2 of FIG. 1, with the stirrer pipe and furnace tapping spout in plan.
Figure 3:
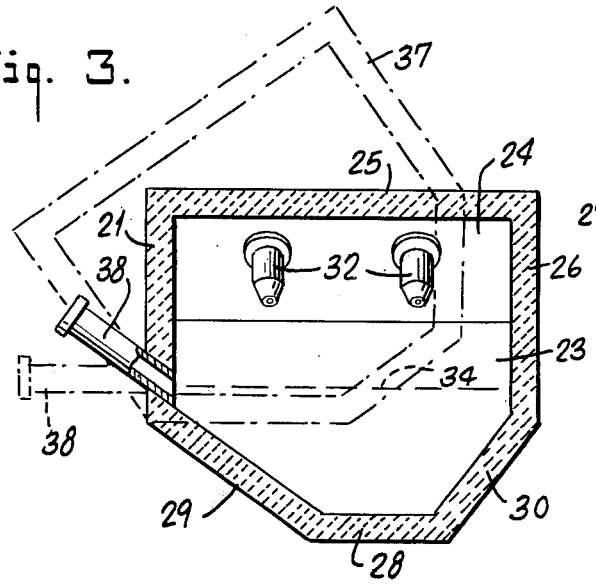
FIGS. 3 and 4 are respectively vertical cross-sections on lines 3—3 and 4—4 of FIG. 2.
Figure 4:
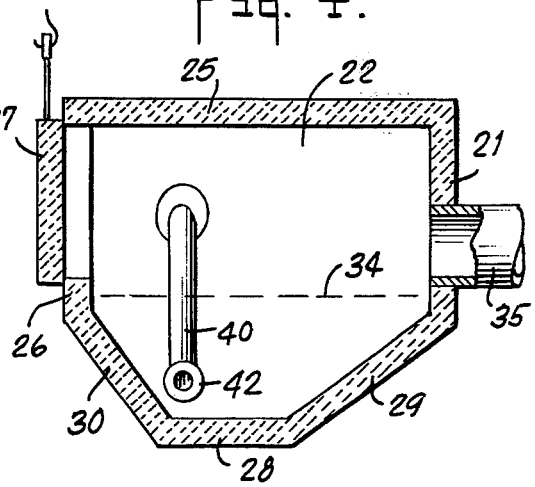

By way of example, FIGS. 1 to 4 are simplified views showing the basic, generally rectangular structure of one form of melting furnace to hold a horizontally extending body of molten metal, e.g. aluminum; this furnace is specifically shaped and arranged to be tilted for tapping. Although in practice made with a heavy steel shell and lined with refractory brick or the like, the drawings simply show a refractory structure, including one long side wall 21, one end wall 22, another end wall 23 having a sloping upper portion 24, and cover or roof 25. The other side wall 26 is open through much of the length of its upper part and is there normally closed by a row of vertically sliding doors 27, as indicated by outline **27*a* showing one moved up to open position. These doors 27 are opened to introduce charge, e.g. scrap, other solid metal, alloying additions, grain refining agents and the like, and also to provide access for observation, sampling, skimming and other purposes. Melted metal can also be so added, or through a separate siphon (not shown). For coaction in removal of metal by tilting, the bottom or floor of the furnace has three lengthwise-extending sections, e.g. a central horizontal part 28, and parts 29, 30 respectively next to the side walls 21, 26 and sloping toward the central part 28**.

Suitable means are provided for heating the body of metal in the furnace, when and as desired; for instance, such means are here embodied in a pair of burners 32 which project obliquely downward through the sloping wall portion 24 and can be suitably fired, e.g. by oil or gas, to direct flame and heat toward the melt body, which may have its surface at an appropriate maximum height as indicated by the dashed line 34. Gases are exhausted from the chamber through a stack 35 which may extend from the wall 21 and through a suitably flexible or jointed connection (not shown) to accommodate the tilting operation.

To tap molten metal, the entire furnace chamber is arranged (in a known manner) to be rocked about an axis adjacent and parallel to the corner between the wall 21 and bottom portion 29, i.e., tilting the furnace toward or to such position as shown by broken lines 37 so that a normally upwardly slanted spout 38 in the wall 21 is tipped downward to allow as much metal as desired to run out, e.g. to a transfer vessel or directly to casting apparatus. Alternatively, of course, siphon means can be provided for removing limited amounts of metal.

In accordance with the invention, a pipe or tube 40, of suitable rugged construction resistant to conditions, extends downwardly at an angle (e.g. 40° to 50° to the vertical) into the furnace, through the wall 22, from a place outside and well above the level 34 of the melt, and terminates in a nozzle 42 preferably close to the floor portion 28 and aimed in a horizontal, longitudinal direction, e.g. generally toward the other end wall and advantageously in a direction (not shown) more or less towards the midpoint of one of the long side walls. The upper end of the tube 40 may extend into a suitable chamber 43, e.g. a shallow, inverter U-shaped tube closed at its remote end 44 as shown, which has a connecting tube or conduit 45 extending to suitable pneumatic means (described below) utilizing gaseous fluid, e.g. air, whereby suction and a flow of such fluid under pressure may be alternately and repeatedly applied to the tube 40.

In this fashion during a suction stage, developing a predetermined degree of vacuum in the upper end of the tube, molten metal is elevated in the tube to a desired level above the normal furnace level 34, where such metal would otherwise stand in the tube. Upon completion of the suction stage, air under pressure is admitted to the upper part of the tube, e.g. through the same conduit 45, so as to expel liquid metal rapidly from the tube through the nozzle 42, beneath the surface of the melt in a direction lengthwise of the furnace. The pressure step may discharge metal to a level in the tube well below the normal level 34, but can be suitably controlled to avoid releasing a bubble of air at the end of the step.

By repetition of the cycles of suction and pressure discharge, metal is alternately drawn in and expelled from the nozzle 42, creating successive, submerged jets of molten metal, preferably in a horizontal direction lengthwise of the furnace with the nozzle disposed as shown. This jet action is roughly and diagrammatically indicated at 47, but it will be understood that the extent, size and shape of the principal jet disturbance may vary considerably, e.g. depending on the actual head of metal in the furnace, presence of solid material to be melted or dissolved, and amount and velocity of metal discharged. It is generally found, however, that a rapid, pulsating, subsurface flow is produced, through a considerable distance from the nozzle 42 and with considerable subsurface turbulence which is of great advantage in stirring, mixing and effecting melting or dissolution of materials in the melt body. The submerged flow, moreover, is found to continue at a more or less constant velocity, through a greater distance, e.g. approaching the remote end of the furnace and returning along the other side (nearer to the wall 21), as generally represented by the arrows 48.

Figure 5:
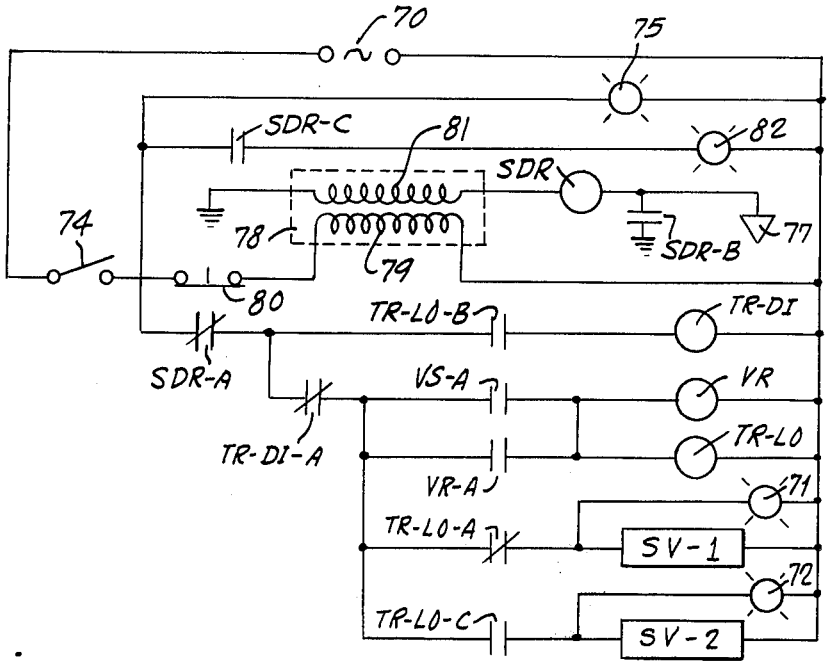
FIG. 5 is a simplified schematic example of an electrical control circuit for pneumatic operation of a stirrer of the invention.
Figure 6:
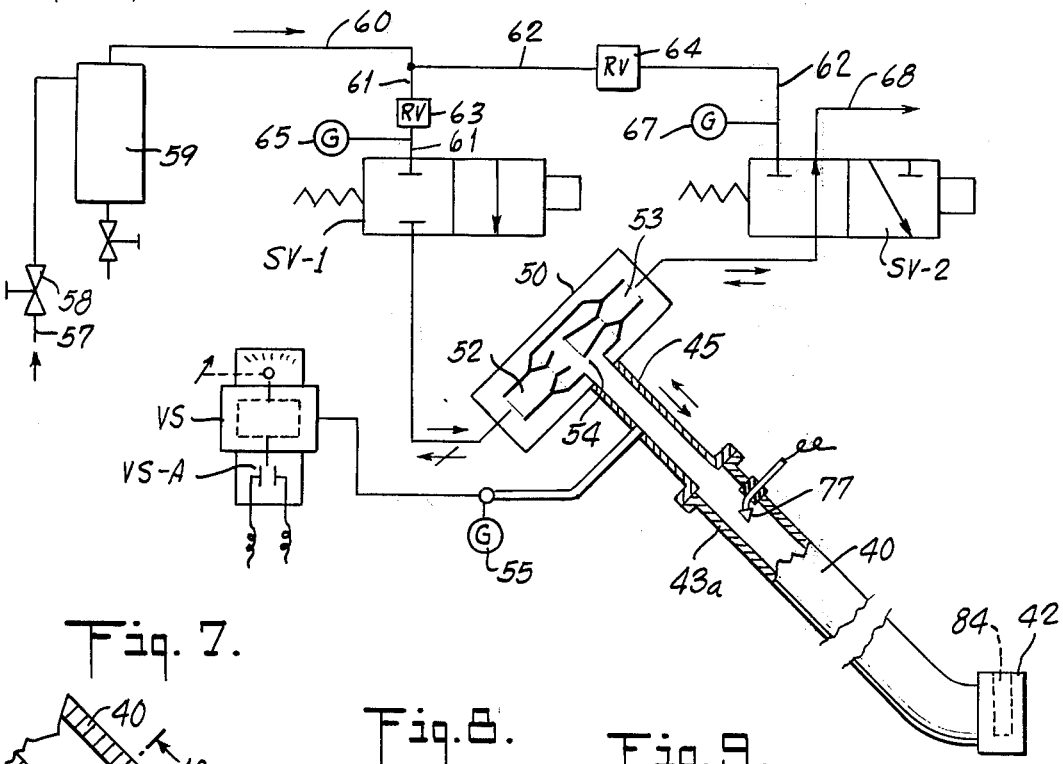
FIG. 6 is a simplified schematic example of a pneumatic system for operating the stirrer, e.g. under control of the circuit of FIG. 5, showing the stirring pipe.
Figure 7:
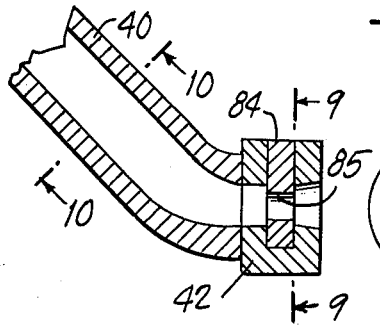
FIG. 7 is an enlarged detail, in longitudinal section, of the lower end of the stirrer in FIG. 6.
Figure 8:
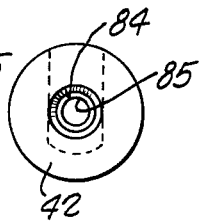
FIG. 8 is an end elevation of the device in FIG. 7.
Figure 9:
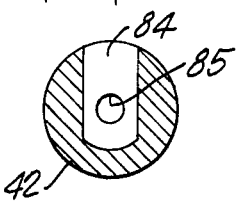
FIGS. 9 and 10 are respectively cross sections on lines 9—9 and 10—10 of FIG. 8.
Figure 10:
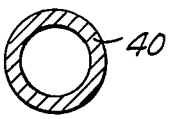

For illustrative example, a simple pneumatic operating system is shown schematically in FIG. 6, with a schematic view of a simplified electrical control circuit in FIG. 5. The pneumatic system includes an ejector 50 of known construction, e.g. having a narrowed throat region between passages 52 and 53 that, in usual ejector function, are intended for inlet and outlet of fluid under pressure, e.g. air, so as to develop suction at a central throat locality which opens laterally into communication with a passage 54. Hence with passage 54 connected to the tube 45 and air flowing under pressure through the ejector 50, i.e., from left-hand passage 52 to right-hand passage 53 in FIG. 6, vacuum is built up in the chamber 43*a* and the upper part of the stirrer pipe 40 above the liquid metal therein. Such vacuum is measured by a gauge 55 and is also communicated, e.g. from the tube 45, to an adjustable vacuum-sensitive switch VS of known type, here arranged to close a pair of electrical contacts VS-A when the vacuum reaches a selected value, for instance as measured in inches of mercury below normal atmospheric pressure.

Control of air supply to and through the ejector 50 is effected by suitable valves, here illustrated as solenoid valves SV-1 (two way, two position) and SV-2 (three way, two position), both shown in spring-retained, electrically deenergized position. Air under pressure is supplied from a suitable source at sufficient pressure, e.g. 90 PSI (pounds per square inch, gauge) to a line 57 including an on-off valve 58 and connected to a tank 59 from which a pipe 60 conducts the air to branch lines 61 and 62. These lines respectively have separately set, constant pressure outlet (regulating) valves 63 and 64 and pressure gauges 65 and 67. The air supply branch 61 extends to one port of the valve SV-1, which has its other port connected to the inlet passage 52 of the ejector 50. The other air supply branch 62 extends to one of two adjacent ports of the valve SV-2, the other adjacent port of such valve communicating through an exhaust line 68 to the atmosphere and the opposite port being connected to the discharge passage 53 of the ejector 50.

In the de-energized position of valve SV-1, shown, its opposite ports are closed, but its valve element, when shifted by energization of its solenoid, is arranged to open communication between the ports, for supply of air under pressure to the ejector passage 52. In the illustrated de-energized position of valve SV-2, one port is closed against passage of air from the line 62, while the other ports are mutually open for communication between the ejector passage 53 and exhaust line 68. The valve element of SV-2, when shifted by energization of its solenoid, closes the port to exhaust line 68 and opens communication between line 62 and the passage 53 of the ejector, so that the latter passage functions, not for discharge, but to receive air under pressure.

The electrical circuit of FIG. 5, receiving power from a conventional A.C. source 70 (e.g. 120 volts), is designed to control energization of the solenoids of valves SV-1 and SV-2 (there so designated) and includes signal lights 71 and 72 respectively connected in parallel with the solenoids. These lights 71 and 72 are thus selectively illuminated to denote loading of the stirrer tube (valve SV-1 energized) with metal and discharging of metal from the stirrer (valve SV-2 energized).

Power is turned on and off by a main start-stop switch 74, of which the closed position is indicated by a power-on signal light 75.

Principal circuit controls are exercised by: a relay VR, conveniently here called a vacuum relay and having normally open (relay de-energized) contacts VR-A; a time delay relay TR-DI (discharge control) having normally closed contacts TR-DI-A; and a time delay relay TR-LO (loading control) having normally closed contacts TR-LO-A and two pairs of normally open contacts TR-LO-B and TR-LO-C. These time delay relays are of the type where shift of the contacts may occur only after an adjustably preset time following energization, with restoration to normal contact relation being immediate upon de-energization. There is also an emergency shutdown relay SDR, having normally closed contacts SDR-A and two pairs of normally open contacts SDR-B and SDR-C.

Further explanation of the schematic examples of FIGS. 5 and 6 is best given by describing their operation. With all relays de-energized, and likewise the solenoid valves as positioned in FIG. 6, the start switch 74 is closed, turning on light 75, and energizing valve SV-1 (through contacts SDR-A, TR-DI-A and TR-LO-A) and loading light 71. Air under pressure is now fed to the ejector 50 and exhausted through line 68 (valve SV-2 remaining de-energized), thereby applying vacuum to the stirrer pipe 40. This initiates the loading phase of the cycle: as vacuum builds up in the pipe, molten metal is drawn in by suction. When the vacuum reaches the value set on the vacuum switch VS — e.g. 11 inches — contacts VS-A close, energizing relay VR, and closing its contacts VR-A. In consequence, relay VR is locked in (regardless of subsequent opening of vacuum switch contacts VS-A), and also through contacts VR-A relay TR-LO is energized to determine the end of the loading step.

Either at once upon energization of relay TR-LO, or after a selected time if that relay is set to function with such delay (permitting further rise of metal in the tube 40, but to a safe extent), the timed contacts of relay TR-LO are shifted. Thus contacts TR-LO-A open, de-energizing solenoid valve SV-1 (and extinguishing its light) and thereby interrupting the suction-producing supply of air to passage 52 of the ejector 50, to terminate loading. At the same time: contacts TR-LO-B close, energizing relay TR-DI and starting its delay time to run; and contacts TR-LO-C also close, energizing valve SV-2 and its signal light 72. With the element of valve SV-2 shifted, air under pressure is rapidly supplied from line 62, via part of the ejector 50 and tube 45, to the head of the stirrer pipe 40 (from which suction had been cut off), so as to expel the load of metal from the pipe 40, in the form of a high velocity, submerged jet through the nozzle 42, constituting the positive phase of the actual stirring operation.

At the end of the preset time of relay TR-DI (while relay TR-LO has remained energized), being the desired short interval for rapid discharge of the molten metal without over-delivery to the extent of expelling a bubble, relay TR-DI times out, opening its contacts TR-DI-A. This immediately de-energizes the solenoid valve SV-2 (and its light 72), ending the metal discharge step. By the same circuit interruption at contacts TR-DI-A, relays VR and TR-LO are also de-energized, with consequent closing of contacts TR-LO-B (to permit re-energization of solenoid valve SV-1).

Because energization of both relays TR-LO and TR-DI is interrupted, their normally closed contacts TR-LO-A and TR-DI-A are now again closed, and the total circuit condition is exactly as described upon the original closure of switch 74. A complete new cycle of operation, including loading and discharge steps, is thus started, and such cycles are automatically repeated (so long as switch 74 is closed), producing the desired, submerged jets of metal in succession from the pipe 40 to achieve the required stirring operation in the body of melt.

An electrically conductive probe 77 extends through insulation into the upper part 43 of the stirrer pipe, to signal and trigger a shutdown operation should metal rise into contact with the probe, i.e., to this unwanted high level. The probe circuit is isolated by a transformer 78 having its primary 79 energized from the A.C. line 70 (when switch 74 is closed) through a normally spring-closed reset switch 80. When metal, at the unwanted level, grounds the probe 77, a circuit is completed through relay SDR, the secondary 81 of transformer 79 and ground, thereby energizing the relay and closing its lock-in contacts SDR-B to ground. Its contacts SDR-C also close, illuminating a shutdown signal light 82. Simultaneously, contacts SDR-A of relay SDR open, and remain open so long as relay SDR is locked in, interrupting electrical power to the entire control circuit of the other relays, and effecting and continuing de-energization of both solenoid valves SV-1 and SV-2. The stirrer thus shuts down, and the metal falls back in the pipe 40. To restart the stirring operation (when the probe 77 is clean), the reset button of switch 80 is momentarily pressed, de-energizing the transformer 78 and thus the relay SDR, restoring the contacts of the latter to their normal (de-energized) positions.

An example of some details presently deemed suitable for the pipe 40 and its nozzle 42 are shown in FIGS. 6 – 10. The pipe can be suitably coated inside and out, and can also be made of material appropriate for handling molten aluminum, for example cast iron containing small additions of molybdenum and chromium, as likewise the heavy housing of the nozzle 42. Seated in a slot in such housing, the functioning nozzle element 84 having a central aperture 85 to define the actual jet (smaller than any other cross section of the system) may have a highly refractory composition, e.g. graphite-bonded silicon carbide, to resist erosion. As will be appreciated, the lower end of the pipe, including the nozzle assembly if necessary, can be shaped not only to provide a bend to a horizontal direction but also to accommodate any additional angle of turn, e.g. where the nozzle is required to project metal at 45° or 90° (in the horizontal plane) to the line which furnace design may dictate for entry of the pipe. The entire pipe assembly may be arranged for ready demounting and removal from the furnace by withdrawal outward, for replacement, repair or the like, or as may be necessary when the furnace shown is tilted for tapping.

Figure 11:
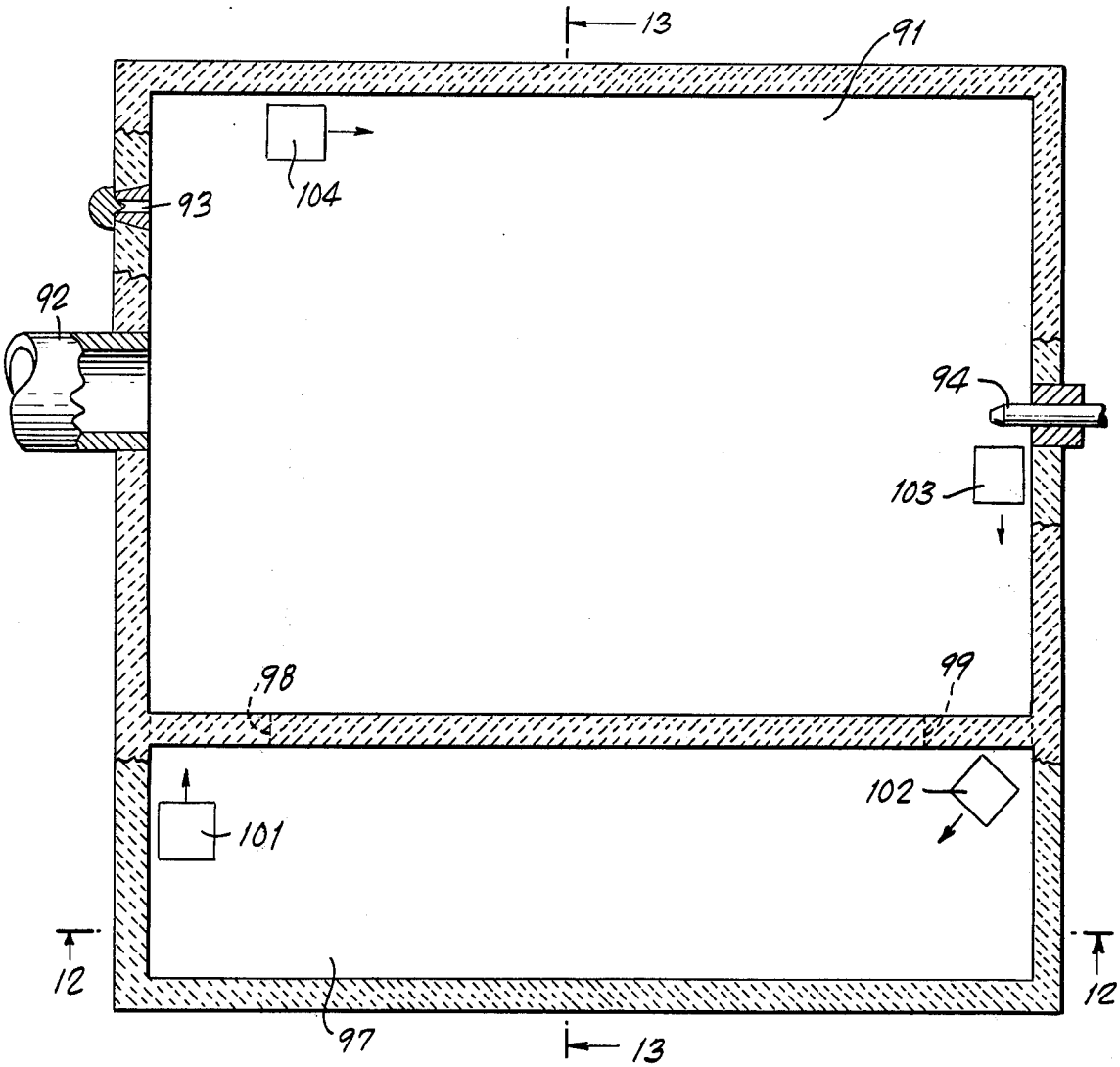
FIG. 11 is a horizontal section, generally on the level of the stack opening but with parts of the section on other levels as indicated by broken lines, of a side well type of furnace, with indication of possible locations for one or more stirrer pipes.
Figure 12:
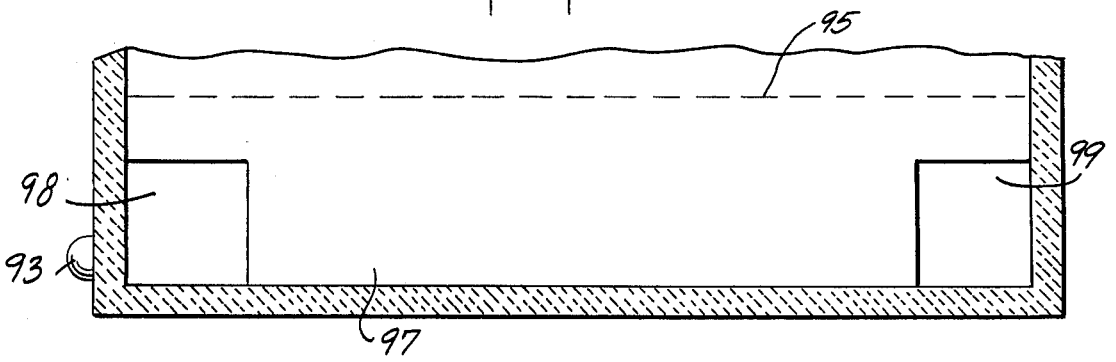
FIGS. 12 and 13 are respectively vertical sections on lines 12—12 and 13—13 of FIG. 11.
Figure 13:
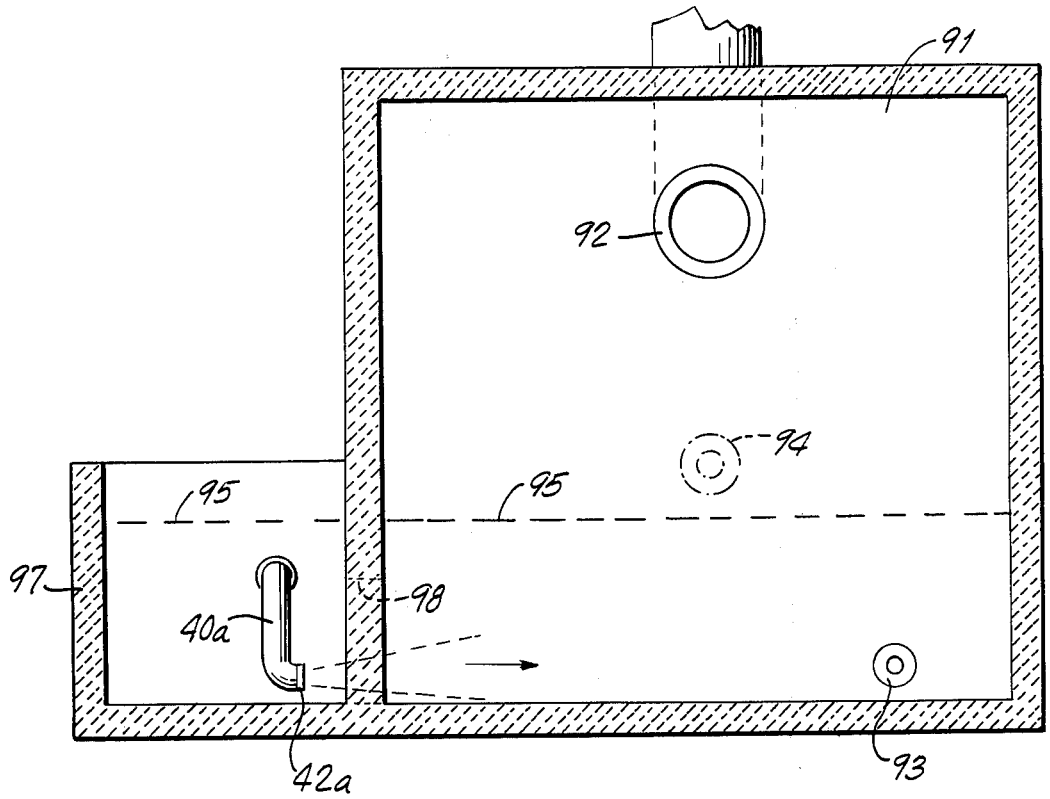

FIGS. 11 to 13 illustrate, in very simplified manner, a form of side well furnace having a rectangular, main, roofed chamber or hearth 91, provided at one end wall with an exhaust stack passage 92 and a normally closed taphole 93, and at the opposite end wall with one or more burners above the metal level, to supply heat, e.g. as indicated by the burner 94 above the surface 95 of the molten metal body. An open narrow side well 97, which may have a removable cover (not shown) if desired, extends along one side wall of the furnace, having free communication with the main chamber through relatively large ports 98 and 99 adjacent the ends of the well, below the metal surface. The side well 97 is chiefly employed for adding some metal charge such as finely divided aluminum scrap (foil, chips), and for introducing additives of alloying elements (or special alloys containing them) and other materials such as grain-refining substances. The main chamber 91 may have a door (not shown) for charging large solid pieces such as heavy ingot.

To illustrate various possible functions of the pneumatically actuated stirring procedure of the invention, FIG. 11 is constituted as a diagrammatic plan showing by box symbols 101, 102, 103 and 104 examples of several locations for a stirring pipe of the character described, it being indeed conceivable that a plurality of such pipes could be installed or insertable at two or more of such places. In each of the symbols, the arrow represents the direction in which the liquid metal is periodically projected; in all cases, the nozzle of the pipe is preferably adjacent to the furnace floor and aimed horizontally.

Thus according to present understanding, jetting from location 101 (in the side well) through the port 98 will mix the melt in the main hearth 91, and pull metal through the side well 97. Directing metal from location 102, diagonally toward the outer wall of the side well (in effect from the port 99), will promote maximum mixing in the side well while pulling metal in from the main hearth. Somewhat similar effects result from jetting at location 103 (near the center of one end wall) toward the port 99, but with lower metal velocity in the well, while enhancing main circulation. Projection of metal from location 104, essentially along the side wall opposite to that which adjoins the side well, will serve predominantly but most effectively to achieve circulation around, and thus mixing throughout, the main hearth 91, e.g. as in the arrangement of FIGS. 1 to 4. By way of practical illustration, FIG. 13 shows a stirring pipe 40*a* at the location 101 (of FIG. 11), with its nozzle 42*a* aimed through the port 98.

With all of the foregoing in mind, it is apparent that many different functions are attainable with various locations of one or more stirring pipes in a furnace. For example, if the inlet port 99 in FIGS. 11 and 12 is made significantly smaller and the device indicated at 103 is brought close to the port 99, mixing in the well can be enhanced in the sense that should there be an obstruction to flow through the outlet port 98, the jet action can produce a finite head of liquid metal in the well. In consequence, there will be an increased chance of desired flow occurring through a quantity of melting scrap metal.

Reverting to FIGS. 1 – 4 inclusive, certain examples of operation of the invention involved a tilting furnace having inside horizontal dimensions of about 32 feet by 11 feet and arranged to hold a maximum of about 110,000 pounds of aluminum. Effective stirring, including submerged, mass circulation essentially throughout the body of melt, was achieved with a stirrer tube 40 at an angle of about 45°, with its nozzle 42 close to the bottom and arranged to project the periodic jets of metal substantially at the place and in the direction shown. The maximum depth of metal in the furnace was about 3 feet, and the total actual length of the straight part of the tube 40 (inside cross section about 45 square inches) up to the chamber part 43 was about 9 feet.

Considering that the discharge phase of each stirring cycle brought the metal in the tube down to less than 12 inches above the bottom, from an elevation (also vertically above the bottom) of about 6 feet at maximum vacuum employed, the amount of aluminum metal discharged in each stroke could be in a range, very roughly, of the order of 200 to 250 pounds. Under conditions further explained below, the exit velocity of the metal jet was about 20 miles per hour, through a nozzle 85 having a diameter of 1½ inches. Some stirring is attainable with much lower velocities, while considerably higher velocities are readily achieved even with moderate air pressures, e.g. below 100 PSI.

The pipe used was of oval configuration, having an interior cross section of 6 inches by 9 inches, but present preference is for a cylindrical pipe, readily coated with temporary refractory wash inside and out. Although in basic aspects the procedure is not limited quantitatively as to the relatively small amount of metal drawn up and discharged in each stirring cycle, it appears, for some significance by way of example, that effective results are attainable in periodically so displacing an amount equal to about 0.1% to 1% of the furnace contents.

In one example of operation of a system shown in FIGS. 5 and 6, the basic air pressure in line 60 was 90 PSI, regulators 63 and 64 being respectively set to deliver air at 75 and 40 PSI (somewhat different pressures were also successfully used). As stated, one effective mode of operation was simply to build up vacuum to a preset value, say 11 inches, and then immediately shift the valves SV-1 and SV-2 (without any time delay such as in relay TR-LO); in this particular case the air pressure for the discharge stroke was delivered through valve SV-2 for 1½ seconds, being the time delay of the discharge relay TR-DI. In other cases (with some preference), there was controlled actual time of suction application at the measured value of vacuum, e.g. 6 to 7 seconds.

More generally, in stirring operations of the sort shown in FIG. 1, presently preferred settings of the vacuum are related to the depth of metal, i.e., the depth of the stirring nozzle 42 below the metal surface in the furnace. The higher the level of metal, the less may be the degree of vacuum required, i.e., to elevate the metal in the tube 40 to a predetermined height. It is presently believed most convenient also to make some time adjustment in the cycling operation, in accordance with change of the depth of metal; it appears that in obtaining a constant rise of metal in the stirrer tube, the assistance of the metal level outside the tube has a direct effect on the vacuum setting and a smaller effect on the vacuum time setting. There is virtually no effect on the time setting for the blow (discharge) setting, as the blow pressure is large compared with the metal level variation.

For instance, where the depth of aluminum metal (in the furnace) was 12, 24 and 36 inches, suitable vacuum settings were about 11, 9 and 7 inches of mercury and appropriate vacuum times (duration of suction application) were 7.0, 6.5 and 6.0, respectively. The discharge (blow) time was 0.5 seconds in all cases; blow times from less than 0.5 sec. to more than 1.5 sec. have been considered feasible, present preference being for shorter durations in such range. AS will be apparent, there is some change in periodicity with the above variations of melt level, e.g. periods of 7.5, 7.0 and 6.5 sec., but periodicity can be kept constant by programming a variable pause (e.g. 0 to 1 sec.) between each blow stroke and the succeeding suction stroke.

Whereas most aluminum melting operations are carried out to have the metal at temperatures of 700° C and chiefly upward, it is noted that at very low metal temperatures, such as 690° to 660° C, the viscosity of aluminum increases, and considerably higher vacuum levels can be used for suction, e.g. 14 inches of Hg at 12 inches of metal in the furnace.

As indicated, very advantageous results have been achieved with the pneumatic stirring procedure, utilized essentially as shown in FIGS. 1 to 4. One operation, that has been repeated satisfactorily many times with full charges of 50 tons, has involved making such melt batches of aluminum, specifically an alloy using scrap and hot (i.e., molten) aluminum, e.g. 20 tons of scrap and 30 tons of hot metal. The scrap and the alloy element or elements (e.g. flake manganese) are first introduced in the furnace and then firing can be effected, while hot metal is added, and can be continued for some time to effectuate complete melting of the batch. In a last part of the firing period, operation of the stirrer is initiated, and is continued thereafter (burners off), for instance during addition of grain refiner, and during a conventional fluxing stage; if sampling proves the batch to be satisfactory, firing can then be continued at a very low level or intermittently, for as long as the batch is held while it is dispensed, e.g. from time to time, for casting.

In such operations, as contrasted with previous practice, considerable saving in time and fuel was noted, e.g. total of about 5 hours instead of about 7 hours, and about 25% less fuel. The economy of energy was greatly aided by lack of necessity to open the doors (usually with burners off) in order to permit stirring by manual or other inserted means. It was noted that stirring time was reduced, while excellent dissolution and mixing of alloying metal was achieved. Incorporation of grain refiner was found to be readily achieved, as also other alloying additions such as iron, during stirring. Homogenization of temperature was a special result: toward the end of the heating period, the top layer of the melt tended to be very hot, and the bottom layer much cooler, but operation of the stirrer produced uniformity of temperature very quickly — e.g. destroying a 50° C thermal gradient in about 5 minutes.

In casting some aluminum alloys, success depends on maintaining a critically specific temperature of the molten metal, e.g. without variation of more than 50° C above or below. Large temperature gradients in the furnace cannot then be tolerated; use of the stirring operation and, if necessary, continuing it from time to time while the metal is held and removed to the caster, can assist in keeping all metal at correct temperature.

Tests indicate that melt loss, e.g. by surface or other oxidation, is not increased by the pneumatic stirring procedure, and indeed appears to be reduced. Likewise, there is no evidence of increase in suspended dirt in the metal from the furnace; indications are that stirring concurrently while fluxing may produce cleaner metal. As stated, the process of the invention maximizes the use of alloying additions, in that there is less proportion that fails to be dissolved and distributed.

It is also apparent that the described stirrer can be employed, if desired, during much of the major melting stage, e.g. to expedite melting of scrap. Tests have indicated that with such stirring, the amount of heat introduced into liquid metal, i.e., per hour, is increased by about 12%. Indeed, stirring while melting solid charge is deemed of advantage in the use of side well furnaces as shown in FIGS. 11 to 13 (one example is a furnace which is about 15 feet square, in plan including the well), both for circulation in the main chamber as well as for rapid flow, with turbulence, through the side well where deposited alloy elements and other additions are thus efficiently incorporated. Because the stirrers are unusually effective in the bottom regions of melt bodies, yet simultaneously with good mixing effect in upper regions, it appears that pneumatic stirring can make furnaces feasible that would handle somewhat deeper batches of metal.

With reference again to practical use of a system such as in FIGS. 5 and 6, an actual start-up operation, after the stirrer pipe has been well heated along its inserted region, can involve: first setting the vacuum switch VS at a low value, e.g. 6 inches Hg, and the blow time (delay of relay TR-DI) short, e.g. a few tenths of a second; and then starting the system and while the suction and discharge cycles proceed for an interval such as 10 minutes or so to get the upper part of the tube heated, raising the settings of vacuum and blow time by steps to the desired ultimate values. Thereafter, the process can continue automatically. For maximum stirring, for example, the ultimate limit of vacuum should be such that there are no contacts of metal with the probe 77 (including the lengthening of the suction or loading interval if a selected delay of relay TR-LO is used) and the ultimate duration of the blow stroke, say one half second to one second or so (selected in 20 to 60 PSI range), such that no bubble is delivered from the nozzle 42. The time delay relays may have suitably large ranges of adjustable delay to accommodate a variety of situations, e.g. 0.1 to 10 seconds for relay TR-DI and 0.6 to 60 seconds for relay TR-LO.

Although other modes of detecting upper levels of metal in the stirrer pipe can be employed, to serve the function of emergency or other probes, an electrical contact type of probe, as shown in diagram, appears to be useful. Alternate methods of terminating the loading stroke, e.g. by time alone or by other probe means, are also deemed feasible. By way of further example, a more elaborate control procedure can utilize a contact probe in the tube 40, below the emergency probe, to register the desired, service level of metal loading. In starting up the operation, such process involves suction strokes for several minutes under control of vacuum reading at 6 inches, then further cycles controlled at an 8-inch limit, and finally controlling the working vacuum stroke by the service probe, thereby inherently always raising metal to desired maximum height regardless of changes of level in the furnace. In this start-up method, the blow time is also successively lengthened to the desired maximum attainable without bubbles. As will now be understood, the foregoing control operation can be effectuated by automatic means employing suitably adjusted instrumentalities.

Compressed air for all systems should of course be dry, with care taken to avod moisture in tank 59. Although the several valves functioning to control suction and blow can if desired be pilot-operated, e.g. actuated by air pressure under separate electrical control, the drawing shows solenoid valves, which appear quite satisfactory.

In summary, the procedure and apparatus of the invention have been demonstrated to afford extremely useful and inexpensive stirring in large bodies of molten metal, particularly light metal such as aluminum, e.g. quantities having considerable horizontal extent and heights of several feet or more, for melting and mixing solid charge in a liquid metal body, for incorporating a variety of additions, and for establishing and keeping homogeneity. Savings of time and heat energy have been achieved, as well as special effectiveness in various mixing actions.

It is to be understood that the invention is not limited to the specific steps and means herein shown and described, but can be carried out in other ways without departure from its spirit.

We claim:

1. In a molten metal operation, the procedure of stirring a body of molten metal comprising alternately withdrawing molten metal upwardly from the body in a confined space to a level above the body and expelling the withdrawn molten metal into the body as a submerged high velocity jet, and repeating said alternate metal-withdrawing and metal-expelling steps to effectuate continued stirring in the body.

2. Procedure as defined in claim 1, in which said alternate metal-withdrawing and metal-expelling steps are effected by alternately applying suction and gaseous fluid under pressure in said confined space above the molten metal body.

3. Procedure as defined in claim 1, in which the submerged jet of expelled metal is projected substantially horizontally.

4. Procedure as defined in claim 3, in which the molten metal is aluminum and the submerged jet is projected at a low region of the body.

5. Procedure as defined in claim 1, in which the predominant dimensions of said body are horizontal and the submerged jet of expelled metal is projected substantially horizontally in a direction in which the molten metal of the body extends for a distance which is substantially greater than the depth dimension of the body.

6. Procedure as defined in claim 5, in which the submerged jet is projected at a low region of the body and in which the alternate metal-withdrawing and metal-expelling steps are effected by alternately applying suction and gaseous fluid under pressure in said confined space above the molten metal body.

7. Procedure as defined in claim 6, in which the molten metal is aluminum.

8. Procedure as defined in claim 5 in which the submerged jet of metal is projected substantially horizontally at a low region of the body.

9. In a molten metal operation, the procedure of stirring a horizontally extending body of molten metal, comprising alternately withdrawing molten metal upward from the body in a confined space to a level above the body and expelling the withdrawn molten metal into the body as a submerged, substantially horizontal, high velocity jet at a low region of the body, and repeating said alternate metal-withdrawing and metal-expelling steps to effectuate continued stirring in the body.

10. Procedure as defined in claim 9, in which the molten metal is aluminum.

11. Procedure as defined in claim 9, in which said alternate metal-withdrawing and metal-expelling steps are effected by alternately applying suction and gaseous fluid under pressure in said confined space above the molten metal body.

12. Procedure as defined in claim 9, in which the molten metal is aluminum and in which the submerged jet of expelled metal is projected in a substantially horizontal direction in which the molten metal of the body extends for a distance which is substantially greater than the depth dimension of the body.

13. In a molten metal operation where a melt body of metal is developed to have at least one horizontal dimension substantially greater than the depth of said body, the procedure of stirring the melt body comprising alternately withdrawing a quantity of molten metal from the body into a tubular vessel that projects downward into the melt body from a locality above the surface thereof, said withdrawal being effected through a restricted opening of said vessel at a lower level of the body, and expelling the withdrawn molten metal as a submerged, high velocity jet through said restricted opening into the melt body, said jet being projected along said lower level of the melt body approximately horizontally, and repeating said alternate metal-withdrawing and metal-expelling steps to effectuate continued stirring in the melt body.

14. Procedure as defined in claim 13, in which the metal of the melt is aluminum, and said alternate metal-withdrawing and metal-expelling steps are effected by alternately applying suction and gaseous fluid under pressure in an upper part of the tubular vessel.

15. Procedure as defined in claim 14, in which said submerged jet is projected horizontally in a direction in which the melt body extends for a distance which is substantially greater than the depth dimension of the body.

16. Procedure as defined in claim 15 which includes disposing said tubular vessel at an angle of 50° to 40° to the horizontal and correspondingly withdrawing metal along a path at such angle.

17. Procedure as defined in claim 14, in which each suction-applying step includes applying suction to the vessel while detecting the value of vacuum being produced in said upper part of the vessel, and controlling the duration of suction application in accordance with arrival of said vacuum at a predetermined value.

18. Procedure as defined in claim 14, in which each suction-applying step includes applying suction to cause molten metal to rise in the vessel, sensing arrival of the surface of said rising molten metal at a predetermind elevation and interrupting said suction application in accordance with the sensed arrival of the metal at said elevation.

19. In combination with molten metal apparatus which comprises means for holding a melt body: apparatus for stirring the molten metal of said body comprising a tubular vessel extending downward into said means and having a nozzle disposed to be submerged in said melt body for projecting molten metal in a substantially horizontal direction, and means for alternately drawing molten metal upward in said vessel to a level above the melt body and causing molten metal to move rapidly downward in said vessel from said level, for alternately and repeatedly drawing a quantity of molten metal from said vessel and expelling said quantity into the body through said nozzle, to stir the molten metal of the body.

20. Apparatus as defined in claim 19, in which the tubular vessel is disposed to extend into said melt-holding means at a side of such means, at an acute angle to the horizontal so that the upper end of said vessel is located laterally outside of the melt-holding means.

21. Apparatus as defined in claim 20, in which said tubular vessel is removably mounted at said side of the melt-holding means, for removal and replacement regardless of presence or absence of molten metal in said melt-holding means.

22. Apparatus as defined in claim 21, in which said molten metal apparatus is a melting furnace in which said melt-holding means comprises a furnace chamber enclosed with a roof, said side of the melt-holding means being a chamber wall through which the tubular vessel removably extends, and said chamber having another wall and burner means extending therethrough for directing heat onto the melt body.

23. Apparatus as defined in claim 19, in which the means for alternately drawing molten metal upward and causing it to move downward comprises means connected to an upper end region of said tubular vessel for therein alternately applying suction and gaseous fluid under pressure.

24. Apparatus as defined in claim 23: in which the suction applying means includes means for controlling the extent of each suction application, to draw molten metal up to a substantially predetermined level in the tubular vessel; and which comprises means including means to sense the level of molten metal in the tubular vessel, for removing suction from the vessel when the molten metal rises to an unwanted high level above the aforesaid predetermined level.

25. In combination with molten metal apparatus which comprises means for holding a melt body: apparatus for stirring the molten metal of said body comprising a tubular vessel extending downward into said means and having a nozzle disposed to be submerged in said melt body for projecting molten metal, and means for alternately applying suction and gaseous fluid under pressure to an upper part of said tubular vessel so that molten metal is alternately and repeatedly drawn into the vessel from the said body and expelled within the body through said nozzle, to stir the metal of the body.

26. Apparatus as defined in claim 25, in which said last-mentioned means includes ejector means adapted to receive a flow of gaseous fluid under pressure for creating suction, vessel-loading means periodically connecting said ejector means for receiving said gaseous flow so as to apply suction to said upper part of the vessel, and vessel-discharging means periodically operated intermediate the periodic operations of said vessel-loading means, for directing a flow of gaseous fluid under pressure into said upper part of the vessel.

27. Apparatus as defined in claim 26, in which said ejector means has three ports and includes a first passage that extends between two of the ports and has a narrowed region, and a second passage opening from the first passage at said narrowed region and communicating through said third port with said upper part of the vessel, said vessel-loading means comprising means for directing gaseous fluid under pressure through said first passage from one of said first two ports to discharge from another of said first two ports, for creating suction in said second passage, and said vessel-discharging means comprising means for closing one of said first two ports, and for directing gaseous fluid under pressure through another of said first two ports, part of said first passage, said second passage, and said third port.

28. Apparatus as defined in claim 27, which includes means providing a source of said gaseous fluid under pressure, a first valve connected between said fluid source means and a first port of the ejector means and having an element which is normally closed between said source means and said last-mentioned first port and is shiftable to open position, a second valve connected to a second port of the ejector means and alternatively to a gas discharge and said source means, and having an element which is normally disposed with said second ejector port open to the gas discharge and is shiftable to connect said second ejector port, instead, to the source means, and control means sequentially effecting operation of said valves for: first shifting the element of the first valve to open position while maintaining the element of the second valve in normal position, to apply suction in the tubular vessel; then restoring the first valve element to normal closed position while shifting the second valve element to connect the second ejector port to the fluid source means, to effectuate delivery of a jet of metal from the tubular vessel; and continuously repeating said sequence of shifting of valve elements.

29. In combination with molten metal apparatus which comprises means shaped to hold a melt body having at least one horizontal dimension substantially greater than the depth of the body: apparatus for stirring the molten metal of said body comprising a tubular vessel extending downward into said means and having a nozzle near the bottom of said means, said nozzle being disposed to project molten metal in a substantially horizontal direction, and means for alternately applying suction and gaseous fluid under pressure to an upper part of said tubular vessel so that molten metal is alternately and repeatedly drawn into the vessel from the said body and expelled within the melt body through said nozzle, to stir the melt of the body.

30. Apparatus as defined in claim 29, in which said melt-body-holding means is bounded by a plurality of walls and said nozzle is disposed to direct the expelled metal in a direction to create metal flow from the vicinity of a first wall toward another wall through a distance greater than the depth of the body.

31. Apparatus as defined in claim 30, in which said melt-body-holding means has two longer walls and two shorter walls and said last-mentioned first wall is a shorter wall.

32. Apparatus as defined in claim 29, in which said tubular vessel extends upward to a locality at an elevation above the melt body which the melt-body-holding means is adapted to hold, said tubular vessel having its upper end closed, and in which said suction and pressure means comprises an ejector having three ports and comprising a first passage between two of the ports and a second passage extending from said first passage to the third port, said third port being in commmunication with the vessel at the upper end of said vessel, and means for alternately and repeatedly (a) directing gaseous fluid through said first passage from one of the said two ports to the other to create suction in said second passage, and (b) directing gaseous fluid through one of said two ports and the first and second passages, while closing the other of said two ports, to create pressure in said second passage.

33. In combination with a metal melting furnace which includes means shaped to hold a horizontally extending melt body: apparatus for stirring the molten metal of said body comprising a tubular vessel having an upper part accessible outside said means and extending downwardly from its upper part into said means, said tubular vessel having a nozzle near the bottom of said means, said nozzle being disposed to project molten metal through the contained molten metal in a substantially horizontal direction, and means for alternately applying suction and gaseous fluid under pressure to an upper part of said tubular vessel so that molten metal is alternately and repeatedly drawn into the vessel from the said body and expelled within the body through said nozzle, to stir the metal of the body.

34. Apparatus as defined in claim 33, in which said melt holding means comprises an enclosed heating chamber of the furnace having walls and a roof, said tubular vessel extending obliquely downward into said chamber through one of said walls, and said furnace including burner means in one of the chamber walls for directing heat into the chamber above the melt body therein.

* * * * *

UNITED STATES PATENT AND TRADEMARK OFFICE

CERTIFICATE OF CORRECTION

PATENT NO. : 4,008,884

DATED : February 22, 1977

INVENTOR(S) : NIGEL PATRICK FITZPATRICK et al.

It is certified that error appears in the above-identified patent and that said Letters Patent are hereby corrected as shown below:

Column 7, line 29, "inverter" should read -- inverted --.

Column 12, line 67, "AS" should read -- As --.

Column 13, line 51, "50°C" should read -- 5°C --.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*